US009015997B2

(12) United States Patent
Roth

(10) Patent No.: US 9,015,997 B2
(45) Date of Patent: Apr. 28, 2015

(54) ARRANGEMENT FOR A METER CABINET, DISTRIBUTION CABINET, SWITCH CABINET OR EMPTY HOUSING

(71) Applicant: ABB AG, Mannheim (DE)

(72) Inventor: Michael Roth, Sasbach (DE)

(73) Assignee: ABB AG, Mannheim (DE)

( * ) Notice: Subject to any disclaimer, the term of this patent is extended or adjusted under 35 U.S.C. 154(b) by 0 days.

(21) Appl. No.: 14/078,856

(22) Filed: Nov. 13, 2013

(65) Prior Publication Data

US 2014/0132138 A1 May 15, 2014

(30) Foreign Application Priority Data

Nov. 14, 2012 (DE) ..... 10 2012 022 240

(51) Int. Cl.

| | |
|---|---|
| ***E05D 15/00*** | (2006.01) |
| ***E05F 7/06*** | (2006.01) |
| ***E05D 7/04*** | (2006.01) |
| ***A47B 96/00*** | (2006.01) |
| ***E05D 7/081*** | (2006.01) |
| ***E06B 1/52*** | (2006.01) |

(52) U.S. Cl.

CPC ..... *A47B 96/00* (2013.01); *E05D 7/0415* (2013.01); *E05D 7/081* (2013.01); *E06B 1/52* (2013.01); *E05Y 2900/208* (2013.01); *E05Y 2900/21* (2013.01); *E05Y 2201/11* (2013.01); *E05Y 2201/71* (2013.01); *E05Y 2900/20* (2013.01); *E05Y 2900/602* (2013.01)

(58) Field of Classification Search

CPC ..... E05D 15/00; E05D 7/04; E05F 7/06
USPC ..... 49/381, 396; 16/245, 246; 312/326
See application file for complete search history.

(56) References Cited

U.S. PATENT DOCUMENTS

| | | | | |
|---|---|---|---|---|
| 3,313,064 | A * | 4/1967 | Kirby | 49/388 |
| 7,653,967 | B2 * | 2/2010 | Lowe et al. | 16/238 |
| 8,683,652 | B2 * | 4/2014 | Hagspiel | 16/238 |
| 2004/0154129 | A1 * | 8/2004 | Martinez-Munoz | 16/250 |
| 2005/0071952 | A1 * | 4/2005 | Chen | 16/252 |
| 2005/0120632 | A1 * | 6/2005 | Chiang | 49/397 |
| 2008/0168621 | A1 * | 7/2008 | Lin | 16/252 |
| 2008/0271292 | A1 * | 11/2008 | Lowe et al. | 16/238 |
| 2013/0283566 | A1 * | 10/2013 | Wach et al. | 16/245 |

FOREIGN PATENT DOCUMENTS

| | | | |
|---|---|---|---|
| DE | 8800918 | U1 | 4/1988 |
| DE | 4108430 | A1 | 9/1992 |

* cited by examiner

*Primary Examiner* — Jerry Redman
(74) *Attorney, Agent, or Firm* — Buchanan Ingersoll & Rooney PC

(57) ABSTRACT

An arrangement is disclosed for a meter cabinet, distribution cabinet or empty housing, including a frame and a door, wherein the frame can carry a door and the door is attached pivotally to the frame on its hinge side. The door may be aligned in relation to its frame quickly and without problems, with an adjustment device for aligning the door in the closed condition, the adjustment device being associated with the frame.

13 Claims, 11 Drawing Sheets

ARRANGEMENT FOR A METER CABINET, DISTRIBUTION CABINET, SWITCH CABINET OR EMPTY HOUSING

RELATED APPLICATION

This application claims priority under 35 U.S.C. §119 to German Patent Application No. 10 2012 022240.8 filed in Germany on Nov. 14, 2012, the entire content of which is hereby incorporated by reference in its entirety.

FIELD

The present disclosure relates to an arrangement for a meter cabinet, distribution cabinet, switch cabinet or empty housing, including for example a frame and a door, wherein the frame carries the door and the door is attached pivotally to the frame on its hinge side. The present disclosure further relates to an adjustment means.

BACKGROUND INFORMATION

DE 88 00 918 U1 discloses a hinge having a pin. The pin may be pushed within a guide by a leaf spring. The leaf spring or the pin has a gripping part for the purpose of manual actuation.

DE 41 08 430 A1 describes a hinge part which is movable inside a guide part. Associated with the hinge part is a spring having toothing that can be brought into engagement with a crosshead screwdriver.

In the known arrangements, a door to be adjusted when the door is open. Adjustment of the door is carried out in the region of the hinges.

In practice, a door can be aligned in relation to a frame that carries the door. For this purpose, the door is opened and closed a number of times. In order to align a door precisely with the frame, at present adjustments are checked successively a number of times, with the door closed. Frequently, when doing this, a number of subsequent adjustments are involved.

SUMMARY

An arrangement is disclosed for a meter cabinet, distribution cabinet, switch cabinet or empty housing, including a frame and a door, wherein the frame is configured to carry the door when the door is attached pivotally to the frame on its hinge side, the arrangement comprising: a door frame; and at least one adjustment means for aligning a door when placed in a closed condition, the adjustment means being associated with the frame.

An adjustment device is disclosed for aligning a meter cabinet door or distribution cabinet door or switch cabinet door in the closed condition, wherein the door is to be attached pivotally to a frame of the respective cabinet or housing on its hinge side, the adjustment device comprising: a frame; an angled element having two flange limbs, oriented at a right angle to one another; at least one elongate hole; a screw connection for fixing the arrangement to the frame; and a free edge of a first flange limb having a toothing, wherein at least one aperture for receiving an axial pin of a door is formed in a second flange limb, wherein the toothing is configured to engage with an external instrument such that the adjustment means and a door when installed are moveable in relation to the frame when the external instrument is actuated.

BRIEF DESCRIPTION OF THE DRAWINGS

A description of exemplary embodiments and further developments will be given with reference to the figures.

In the figures.

DETAILED DESCRIPTION

Figure 1:
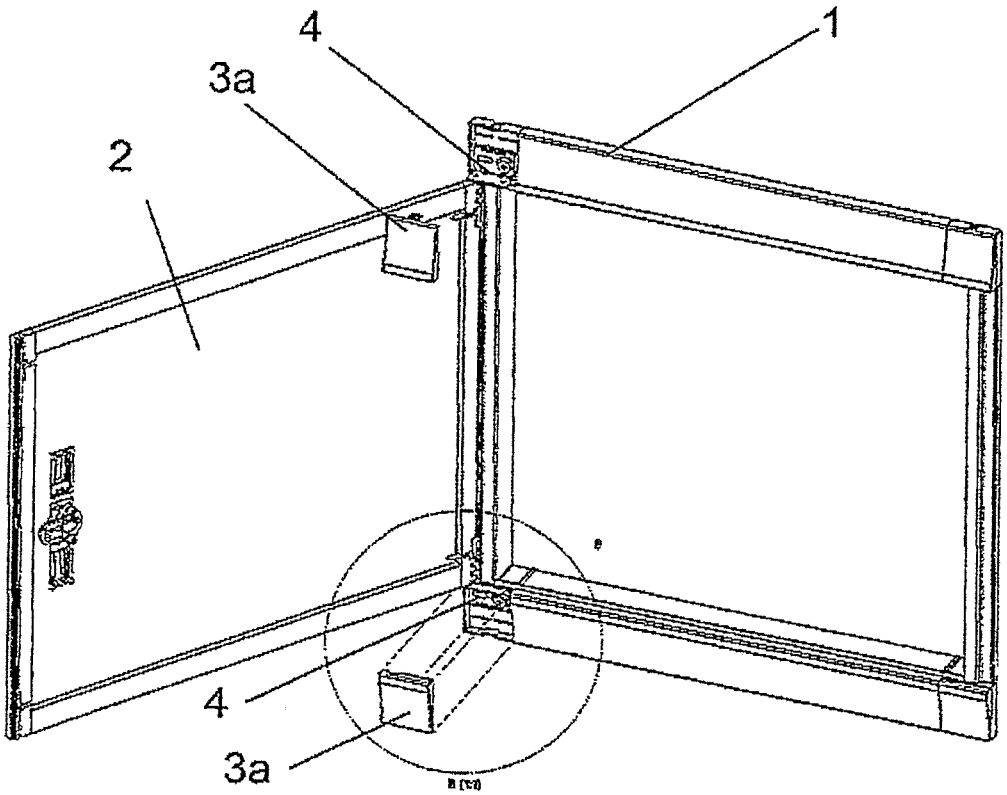
FIG. 1 shows an exemplary arrangement having a frame and a door, wherein the door is open.

An arrangement is disclosed by means of which a door may be aligned in relation to its frame quickly and without problems.

An exemplary arrangement as disclosed herein includes at least one adjustment device as a means for aligning the door in the closed condition which is associated with the frame.

It has been realized that an adjustment means arranged on the frame can be actuated regardless of the position of the door. An adjustment means arranged in this manner is accessible without causing problems for an assembly person even when the door is closed. By securing the adjustment means exclusively to the frame while, for example, an axial pin of the door projects into the adjustment means, it is possible to displace the hinge axis of the door without opening the door. In this respect, the door may be aligned in relation to its frame in the closed condition. The door may be aligned in relation to its frame quickly and without problems, without opening and closing procedures.

For example, the adjustment means can be arranged on the hinge side of the frame. This allows the hinge axis of the closed door to be suitably tilted and aligned by displacing the adjustment means parallel to the plane of the door leaf.

Furthermore, the adjustment means can be received in a corner part of the frame that is accessible to an assembly person when the door is closed. As a result of this, the adjustment means may be actuated without problems. A corner part can take the form of a separate component which may be connected to the frame.

According to a further exemplary embodiment, the inner space of the corner part may be covered by a cover. In this way, the adjustment means may be protected from soiling.

Moreover, covers may be adapted to the design of the frame and/or the door and thereby have a positive effect on the visual impression of the arrangement.

Furthermore, the adjustment means may be fixed to the frame by a securing screw. When the securing screw is loosened, the adjustment means may be brought into a condition in which it may be displaced. After displacement into a correct position, the adjustment means may be kept in this position by the securing screw.

This being the case, the adjustment means can have a toothing that may be brought into engagement with an external instrument such that the adjustment means may be moved in relation to the frame when the external instrument is actuated. As a result of this, the adjustment means may be moved from the outside.

The external instrument can be, for example, a crosshead screwdriver. This common tool may be used by an assembly person to displace and position the adjustment means.

Furthermore, the frame can have profiled sections on its upper and/or lower longitudinal sides. The profiled sections may be adapted to the design of the frame and/or door and so have a positive effect on the visual impression of the arrangement. The profiled sections furthermore stabilize the frame.

According to exemplary embodiments, at least one elongate hole is provided in the adjustment means and/or in the corner parts. As a result of this, the entire frame may be rotated and/or fixed by means of one or more securing screws.

Furthermore, the adjustment means can take the form of an angled element which has two flange limbs that are oriented at a right angle to one another. This exemplary embodiment enables the adjustment means to abut against the corner part with one flange limb and to project away from it with another flange limb.

This being the case, a free edge of a first flange limb can be provided with a toothing, wherein at least one aperture for receiving an axial pin of the door is formed in a second flange limb. This constructional feature allows the toothing to be actuated by means of a crosshead screwdriver, as a result of which the adjustment means is displaced and the axial pin is carried along with the door.

FIG. 1 shows an exemplary arrangement for a meter cabinet, distribution cabinet or empty housing, including a frame 1 and a door 2, wherein the frame 1 carries the door 2 and the door 2 is attached pivotally to the frame 1 on its hinge side.

At least one adjustment means 4 for aligning the door 2 in the closed condition is associated with the frame 1.

In a concrete construction, two adjustment means 4 are provided on the hinge side of the frame 1, and are freely accessible both when the door 2 is open and when it is closed.

Figure 2:
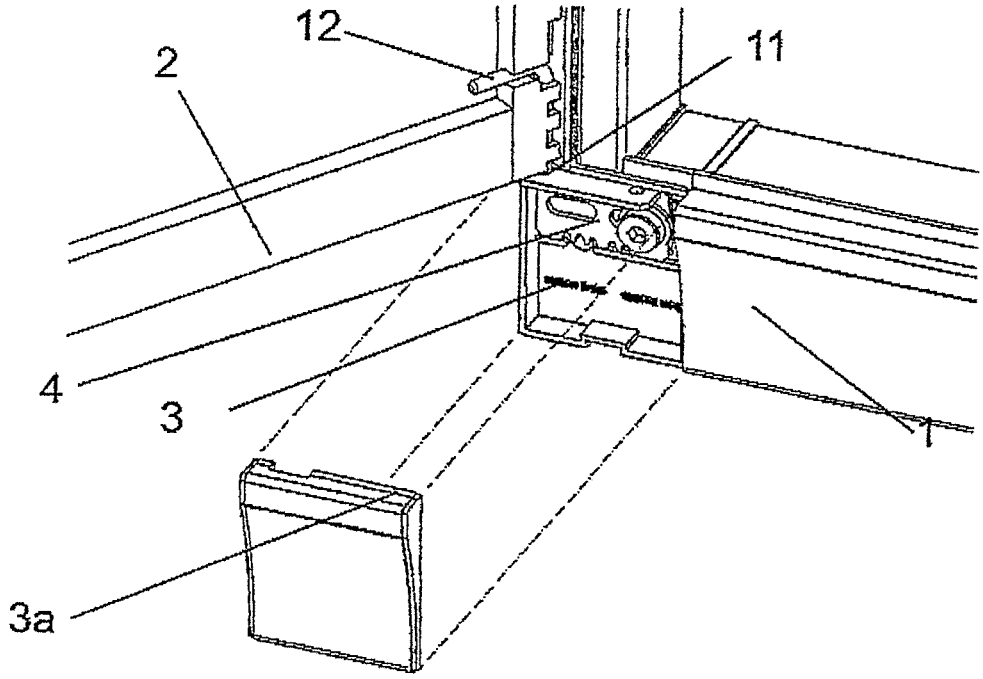
FIG. 2 shows a detailed view of an exemplary lower left-hand corner part with the door open.

FIG. 2 shows in a detail that at least one adjustment means 4 is arranged on the hinge side of the frame 1. The adjustment means 4 is received in a corner part 3 of the frame 1 that is accessible to an assembly person when the door 2 is closed. The inner space of the corner part 3 may be covered by a cover 3*a*. The adjustment means 4 is received in this inner space.

Figure 3:
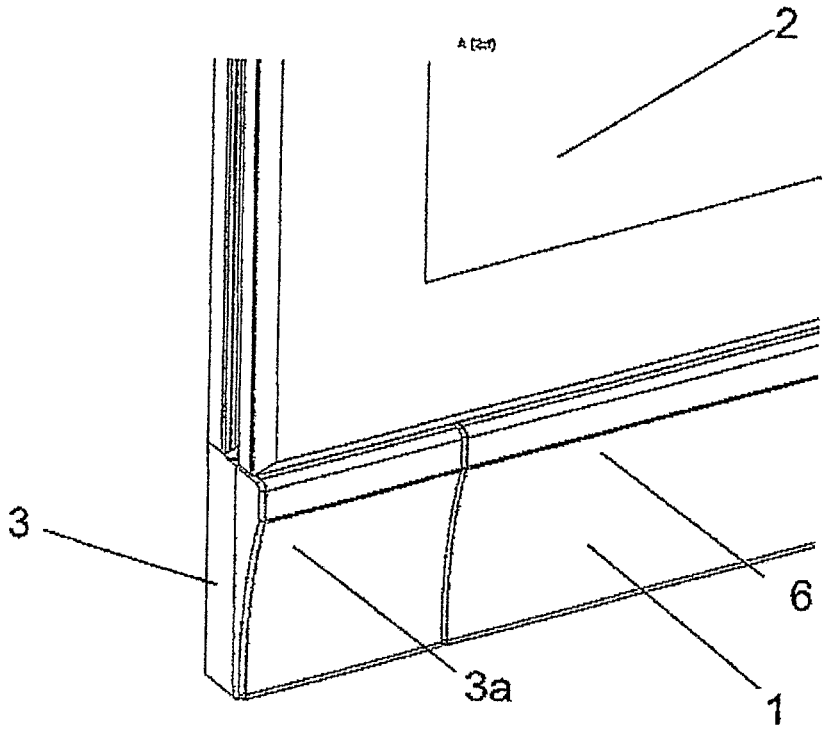
FIG. 3 shows a detailed view of an exemplary lower left-hand corner part with the door closed.
Figure 4:
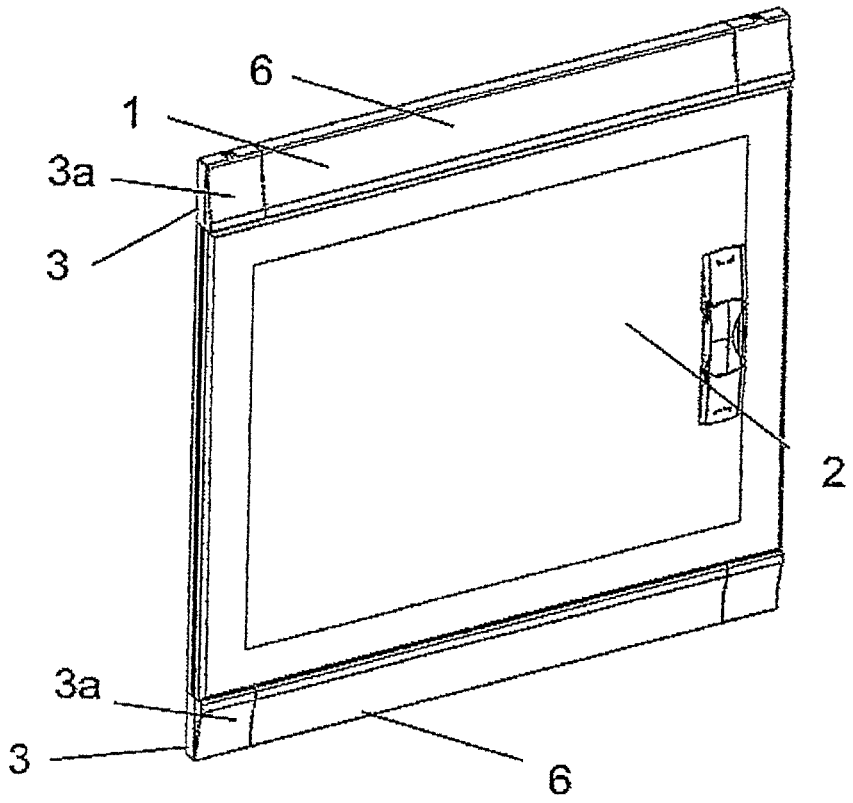
FIG. 4 shows the exemplary arrangement with a frame and a door, wherein the door is closed.

FIGS. 3 and 4 show an exemplary arrangement with covers 3*a* placed on two corner parts 3.

Figure 5:
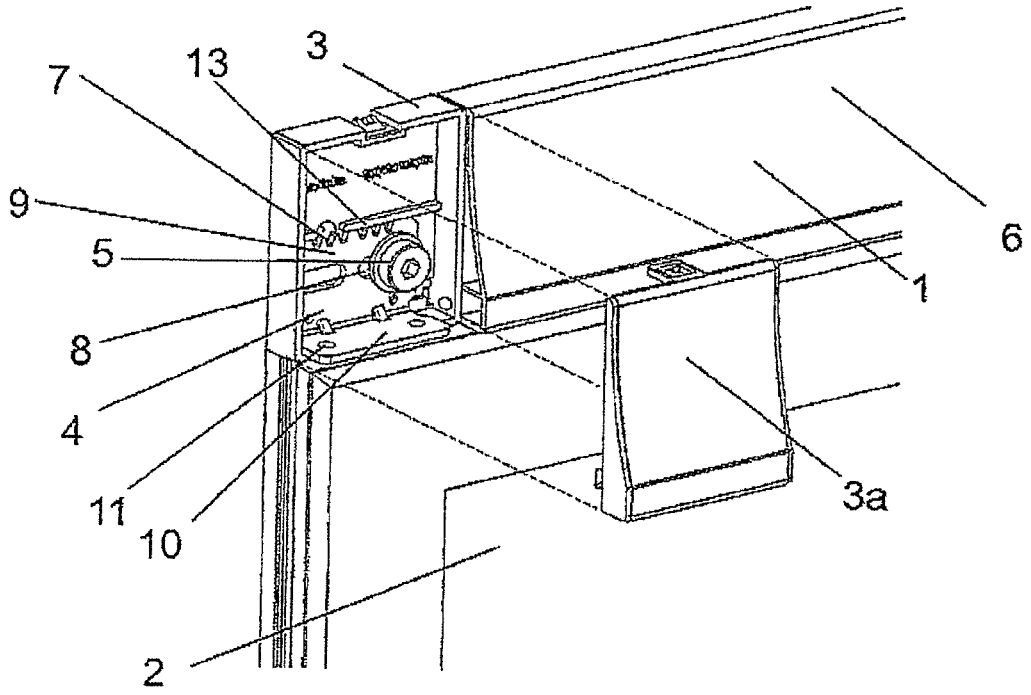
FIG. 5 shows a detailed view of an exemplary upper left-hand corner part with the door closed and the cover removed.
Figure 6:
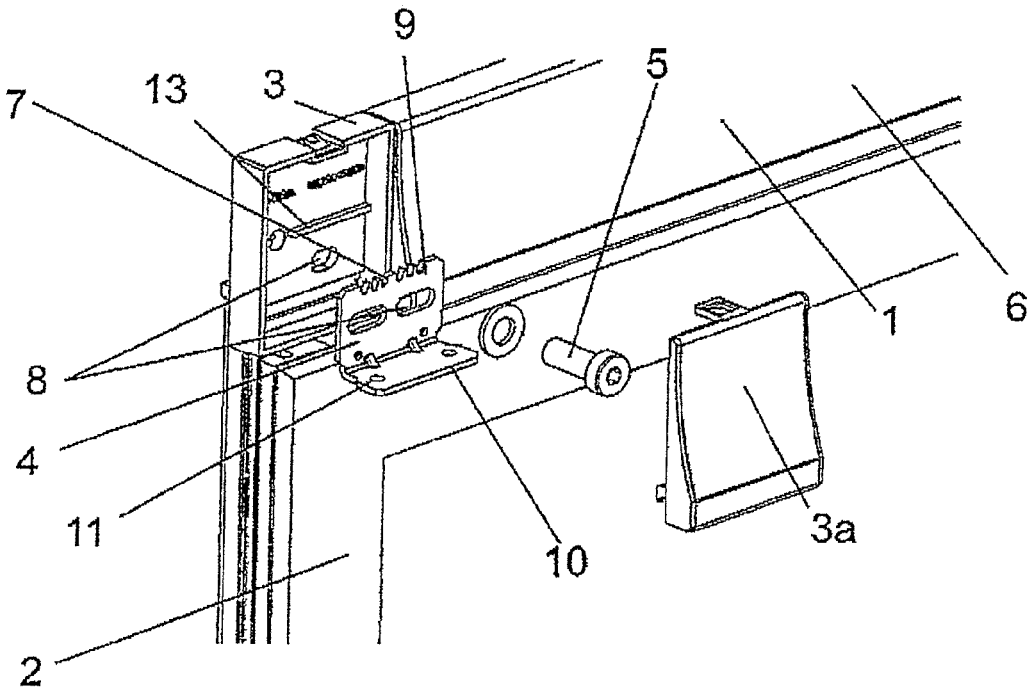
FIG. 6 shows an exploded illustration of an exemplary upper left-hand corner part with the door closed and the cover removed.

FIGS. 5 and 6 show, by way of the example of an upper left-hand corner part 3, that the adjustment means 4 may be fixed to the frame 1 using a securing screw 5.

Figure 7:
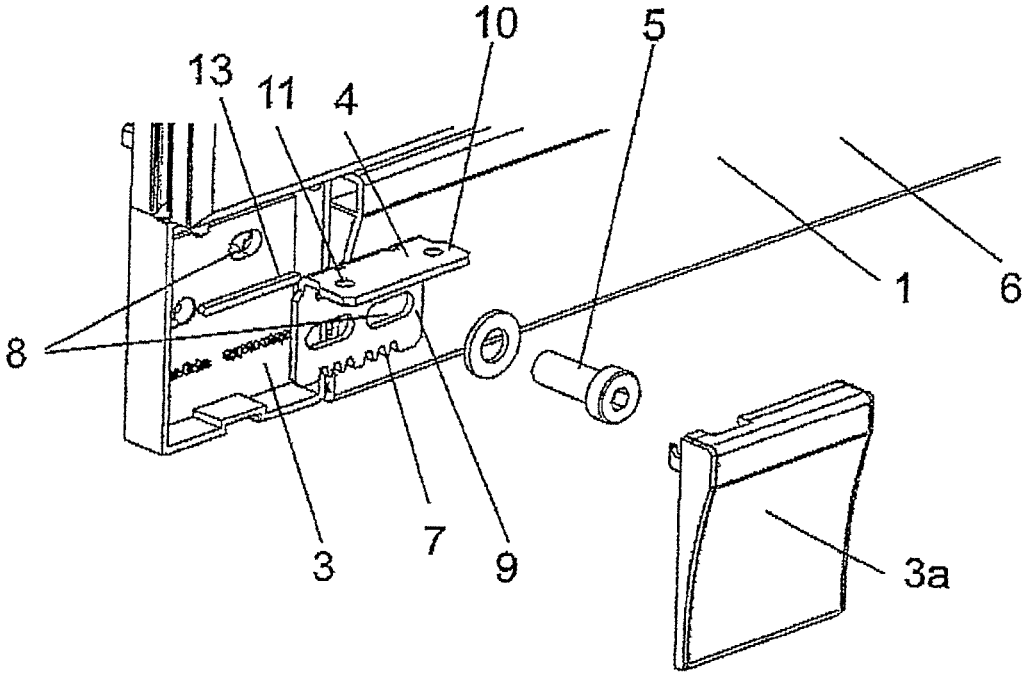
FIG. 7 shows an exploded illustration of an exemplary lower left-hand corner part with the door closed and the cover removed.

FIG. 7 shows this by way of the example of a lower left-hand corner part 3.

FIGS. 5 to 7 show that the adjustment means 4 can have a toothing 7 that may be brought into engagement with an external instrument such that the adjustment means 4 may be moved in relation to the frame 1 when the external instrument is actuated. At least one elongate hole 8 is provided in the adjustment means 4 and/or the corner parts 3.

The adjustment means 4 can take the form of an angled element which has two flange limbs 9, 10 that are oriented at a right angle to one another. A free edge of a first flange limb 9 is provided with a toothing 7, wherein at least one aperture 11 for receiving an axial pin 12 of the door 2 is formed in a second flange limb 10.

Figure 8:
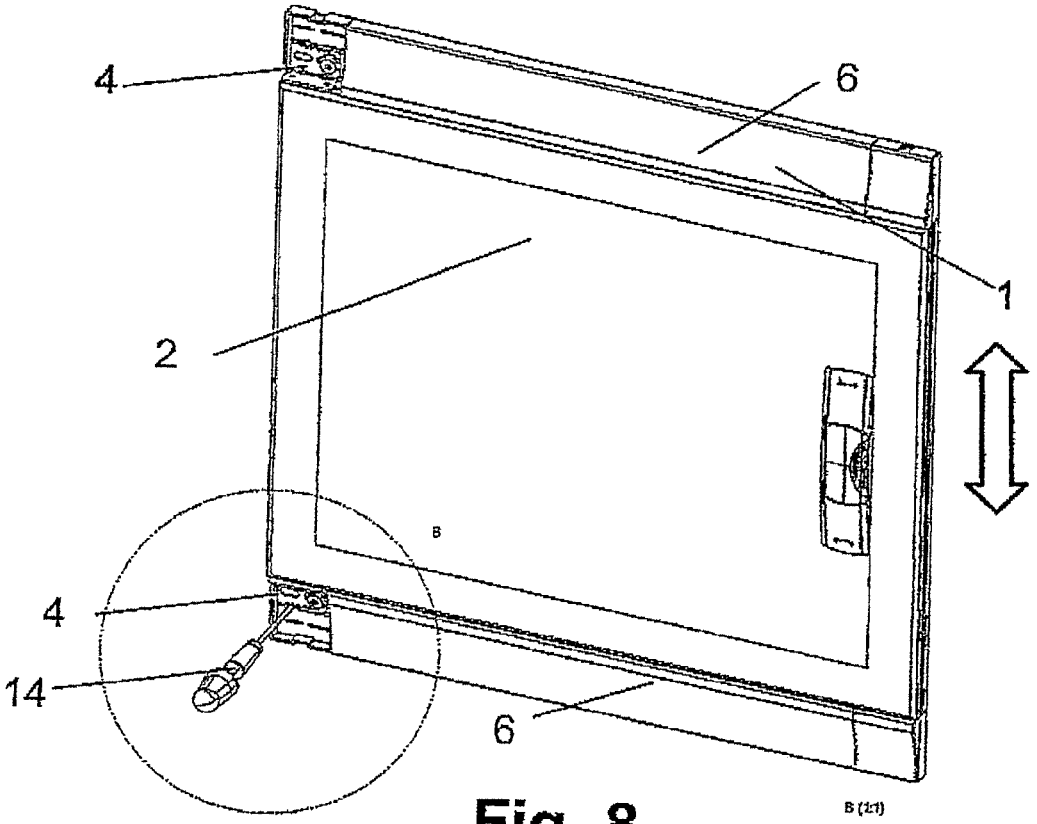
FIG. 8 shows an exemplary arrangement with a frame and a door, wherein the door is closed and the lower left-hand cover is removed.

FIG. 8 shows that the external instrument can take the form of a crosshead screwdriver 14. FIG. 8 further shows that it is possible to align the door 2 when it is closed.

For alignment of the door 2, all that is needed is for the covers 3*a* to be removed and for the crosshead screwdriver 14 to be brought into engagement with the toothing 7 and turned. By way of example, the double-headed arrow indicates possible directions of movement of the door 2 when the crosshead screwdriver 14 is turned.

Figure 9:
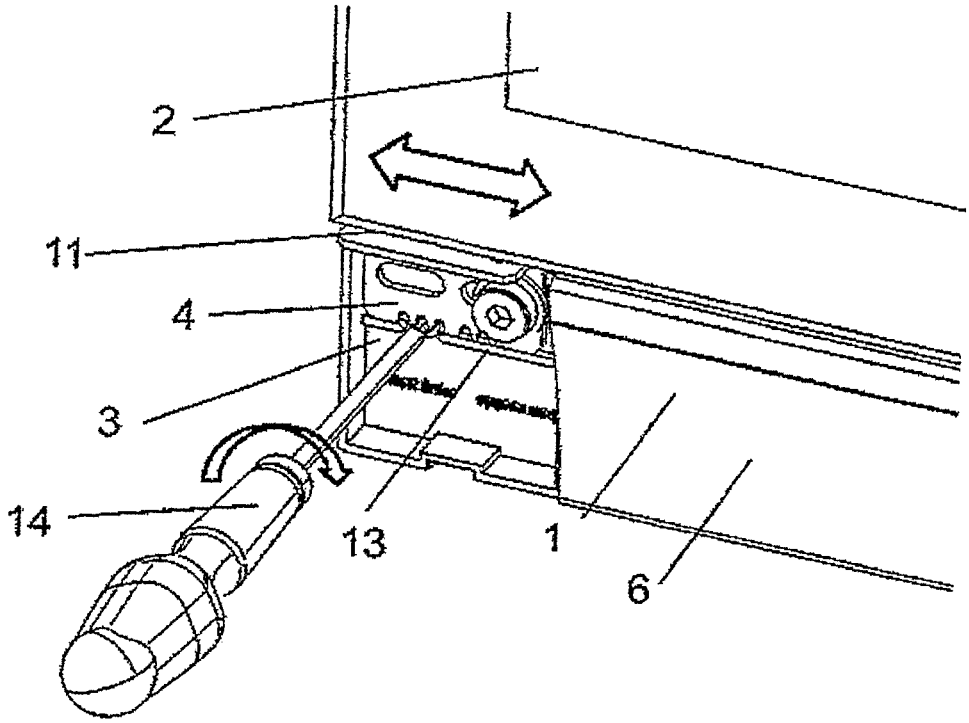
FIG. 9 shows a detailed view of an exemplary lower left-hand corner part with the cover removed.

FIG. 9 shows this in a detail by way of the example of the lower left-hand corner part 3.

FIG. 8 also shows that the frame 1 can have profiled sections 6 on its upper and lower longitudinal sides.

Figure 10:
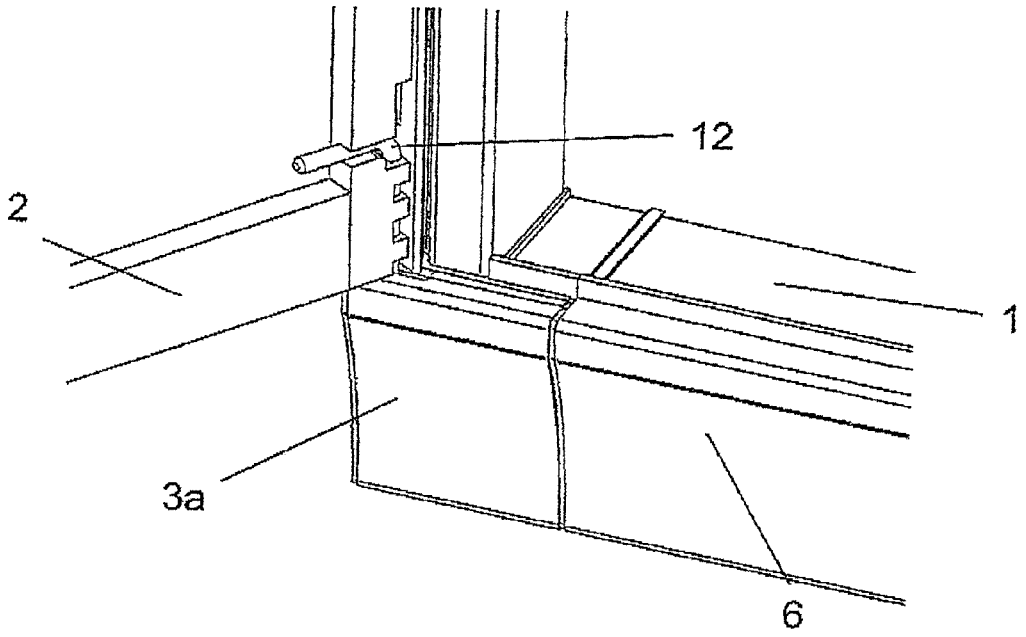
FIG. 10 shows a detailed view of an exemplary lower left-hand corner part with the cover closed.

FIGS. 10 and 2 show that the door 2 can engage in the adjustment means 4 by means of an axial pin 12 and is mounted pivotally.

An exemplary arrangement can include three basic elements, namely a frame 1 which may be welded, pushed in and/or screwed, a door 2 which may take the form of a sheet-metal door, glass door or synthetic door, and corner parts 3 which serve to receive an adjustment means 4 and may be covered from the outside.

Parts of the frame 1 made from synthetic material, aluminium or sheet metal may be screwed to a corner part 3, pushed into it and/or welded to it. A corner part 3 serves to receive and guide an adjustment means 4.

The adjustment means 4 is secured, together with a corner part 3, to a cabinet housing. Here, it is unimportant whether the frame 1 is screwed to a wall-mounted housing or a flush-mounted housing. With the flush-mounted construction, the length of a securing screw 5 may be adapted to match the depth of plaster as desired.

If the frame 1 is screwed to a cabinet with the door 2 closed, the door 2—which may hang down on the lock side as a result of its weight—may be adjusted in the region of its hinge side to fit the frame 1, from the outside by way of the adjustment means 4, that is to say with the door 2 closed.

Once the securing screw 5 has been loosened slightly, a crosshead screwdriver 14 can be applied to a toothing 7 of the adjustment means 4. The adjustment means 4 can be displaced by turning the crosshead screwdriver 14.

Displacement of the adjustment means 4 can alter the position of the centre axis of the hinge. This has the effect of moving the door 2 upwards or downwards on the lock side.

The entire frame 1 may be rotated in its position by means of the securing screws 5, through elongate holes 8 in a corner part 3. Rotation is performed vertically. Once the frame 1 and the door 2 have been adjusted, the covers 3*a* of the corner parts 3 may be latched back onto the latter.

In order to perform the adjustment procedure mentioned above, at least one corner part 3 having an adjustment means 4 can be used. The covers 3*a* have no function in respect of the adjustment and may be adapted to the respective design of the profiled sections 6 arranged at the top and bottom of the frame 1.

The profiled sections 6 of the frame 1 are for example made from synthetic material, aluminium or sheet metal.

The door 2 is for example made from sheet metal, synthetic material or glass. In the case of a door 2 made from glass, an additional carrying frame could be provided.

The corner parts 3 are for example made from synthetic material, sheet metal or die-cast zinc.

In a corner part 3, at least one guide 13 is for example provided for the adjustment means 4. The guide 13 can take the form of a web along which the teeth of the toothing 7 can slide by means of their tooth tips.

The adjustment means 4 is for example made from sheet metal or synthetic material. The toothing 7 is adapted to the crosshead screwdriver 14.

The covers 3*a* are for example made from synthetic material or sheet metal.

Figure 11:
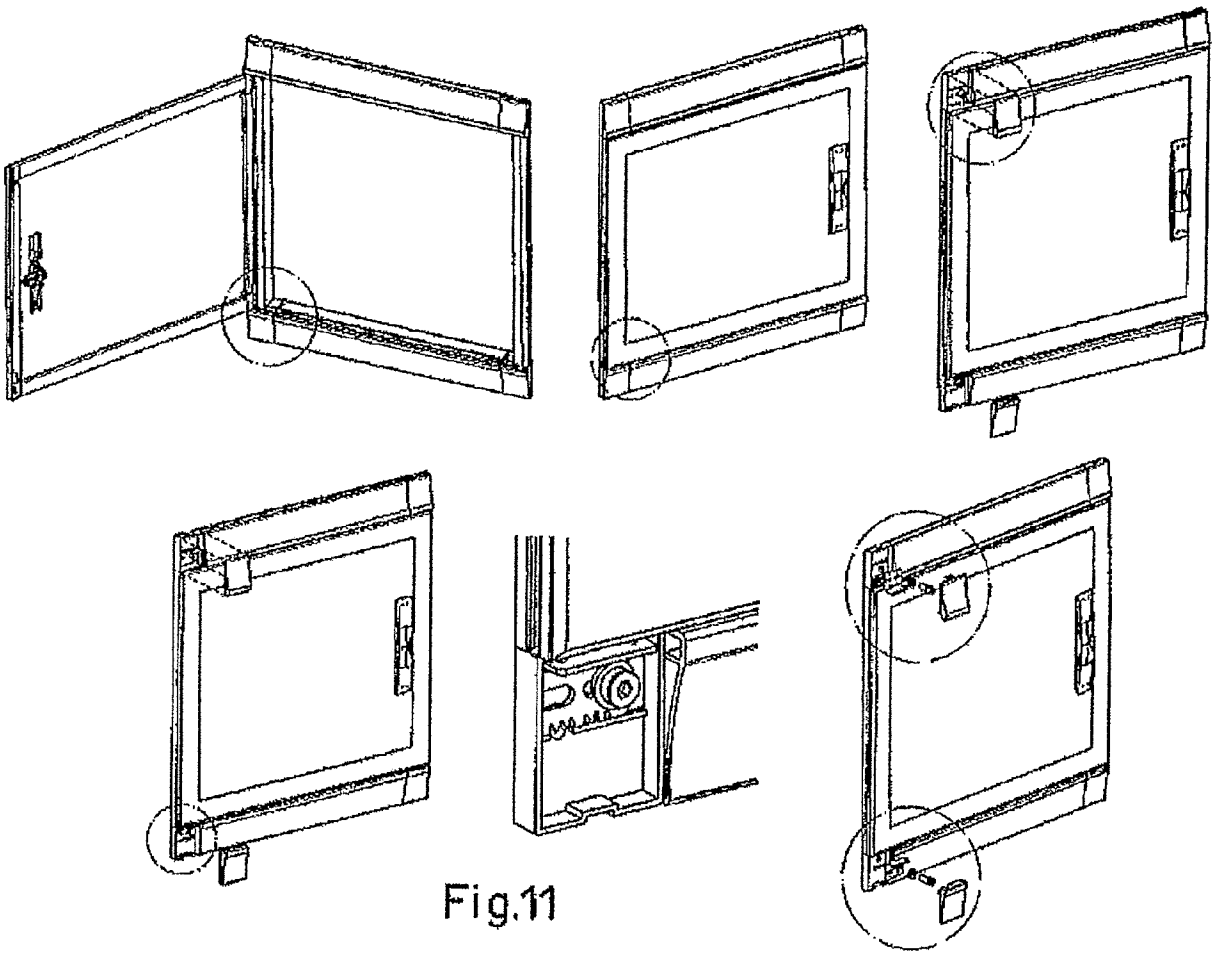
FIG. 11 shows further views of the exemplary arrangement shown in part or in its entirety in FIGS. 1 to 10.

FIG. 11 shows further views of an exemplary arrangement illustrated in part or in its entirety in FIGS. 1 to 10.

Exemplary embodiments disclosed herein also include any combinations of preferred exemplary embodiments and individual constructional features or further developments, provided these are not mutually exclusive.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCE NUMERALS

1 Frame
2 Door
3 Corner part
3*a* Cover
4 Adjustment means
5 Securing screw
6 Profiled section
7 Toothing
8 Elongate hole
9 First flange limb
10 Second flange limb
11 Aperture
12 Axial pin
13 Guide
14 Crosshead screwdriver

The invention claimed is:

1. Arrangement for a meter cabinet, distribution cabinet, switch cabinet or empty housing, including a frame and a door, wherein the frame is configured to carry the door which is attached pivotally to a hinge side of the frame, the arrangement comprising:

at least one adjustment means for aligning the door when placed in a closed condition, wherein the adjustment means is associated with the frame, wherein the adjustment means is an angled element which has a first and a second flange limb which are oriented at a right angle to one another, wherein a free edge of the first flange limb comprises a toothing, wherein at least one aperture for receiving an axial pin of the door is formed in the second flange limb, and wherein the toothing is configured to be brought into engagement with an external instrument such that the adjustment means is movable in relation to the frame when the external instrument is actuated.

2. Arrangement according to claim 1, wherein the adjustment means is arranged on the hinge side of the frame.

3. Arrangement according to claim 2, wherein the adjustment means is in a corner part of the frame that will be accessible to an assembly person when the door is closed.

4. Arrangement according to claim 3, wherein an inner space of the corner part is covered by a cover.

5. Arrangement according to claim 4, wherein the adjustment means is fixed to the frame by a securing screw.

6. Arrangement according to claim 5, wherein the frame comprises:

profiled sections on upper or lower longitudinal sides of the frame.

7. Arrangement according to claim 6, comprising:

at least one elongate hole in the adjustment means and/or in a corner part.

8. Arrangement according to claim 1, wherein the adjustment means is in a corner part of the frame that will be accessible to an assembly person when the door is closed.

9. Arrangement according to claim 8, wherein an inner space of the corner part is covered by a cover.

10. Arrangement according to claim 1, wherein the adjustment means is fixed to the frame by a securing screw.

11. Arrangement according to claim 1, wherein the frame comprises:

profiled sections on its upper and lower longitudinal sides.

12. Arrangement according to claim 1, comprising:

at least one elongate hole in the adjustment means and in a corner part.

13. An adjustment device for aligning a door of a meter, distribution, or switch cabinet in the closed condition, wherein the door is to be attached pivotally to a hinge side of a frame of the cabinet, the adjustment device comprising:

an angled element having two flange limbs, oriented at a right angle to one another;

at least one elongate hole;

a screw connection for fixing the arrangement to the frame; and a free edge of a first flange limb of the two flange limbs having a toothing, wherein at least one aperture for receiving an axial pin of the door is formed in a second flange limb of the two flange limbs, wherein the toothing is configured to engage with an external instrument such that the adjustment device and the door are movable in relation to the frame when the external instrument is actuated.

* * * * *